US005154756A

United States Patent [19]

Nakajima et al.

[11] Patent Number: 5,154,756

[45] Date of Patent: Oct. 13, 1992

[54] METHOD AND APPARATUS FOR PRELIMINARY TREATMENT OF MOLTEN HOT METAL

[75] Inventors: Yoshio Nakajima; Yasutami Fukami, both of Hiroshima, Japan

[73] Assignee: Nisshin Steel Co., Ltd., Tokyo, Japan

[21] Appl. No.: 476,502

[22] PCT Filed: Dec. 9, 1988

[86] PCT No.: PCT/JP88/01245

§ 371 Date: Jun. 11, 1990

§ 102(e) Date: Jun. 11, 1990

[87] PCT Pub. No.: WO89/05360

PCT Pub. Date: Jun. 15, 1989

[30] Foreign Application Priority Data

Dec. 11, 1987 [JP] Japan ..... 62-312341

[51] Int. Cl.[5] ..... C21C 7/02

[52] U.S. Cl. ..... 75/538; 75/560; 266/162

[58] Field of Search ..... 75/537, 560; 266/162

[56] References Cited

U.S. PATENT DOCUMENTS 3,406,027 10/1968 Bonilla ..... 75/537

4,515,630 5/1985 Tyler ..... 75/537

*Primary Examiner*—Peter D. Rosenberg

*Attorney, Agent, or Firm*—Wenderoth, Lind & Ponack

[57] ABSTRACT

A method for the preliminary treatment of molten hot metal for steel making comprising passing molten hot metal towards the downstream side in a horizontally disposed trough-like vessel and injecting obliquely downwards a powdered refining agent into the molten hot metal by use of an oxygen-containing gas as a carrier through one or more single-pipe nozzles installed on the side wall of the vessel with the nozzle port being positioned below the surface of the hot metal in the vessel.

2 Claims, 4 Drawing Sheets

METHOD AND APPARATUS FOR PRELIMINARY TREATMENT OF MOLTEN HOT METAL

FIELD OF THE INVENTION

The present invention relates to a method and apparatus for the preliminary treatment such as desiliconization and dephosphorization of molten pig iron (referred herein as molten hot metal) prior to the decarburization refining of the molten hot metal for steel making.

BACKGROUND OF THE INVENTION

Known methods for the desiliconization and dephosphorization of molten hot metal for steel making which is flowing in a delivery trough of a blast furnace by adding thereto a powdered refining agent, may be roughly classified into the following 4 methods. The same classification may be made of known methods for the preliminary treatment of molten hot metal continuously caused to pass in a horizontally disposed elongated vessel from one end to another.

(1). As diagrammatically shown in FIG. 1, a top placing method wherein a powdered refining agent 2 is sprayed by its own weight on the surface of molten hot metal 1 continuously flowing in a trough.

(2). As shown in FIG. 2, a top blowing projection method wherein a powdered refining agent 2 is projected onto the surface of molten hot metal 1 continuously flowing in a trough by use of a non-oxidizing carrier gas 4 through a lance 3 disposed with its front end positioned above the surface of the molten hot metal.

(3). As shown in FIG. 3, a top blowing injection method wherein a powdered refining agent 2 is injected into molten hot metal 1 continuously flowing in a trough by use of a non-oxidizing carrier gas 4 through a lance 5 disposed with its front end positioned below the surface of the molten hot metal.

The top blowing projection method (2) above is disclosed in JP B 61-45,681.

Besides the above-mentioned methods, we have proposed in JP A 60-177,114, JP A 60-177,117 and JP A 60-181,212 wherein a powdered refining agent is injected into molten hot metal by use of an oxygen-rich gas, instead of a non-oxidizing gas, as a carrier, wherein the mixture of the oxygen-rich gas and the powdered refining agent is bottom blown through single-pipe nozzles instead of tuyeres of a double tube structure. In these methods solid products formed by reaction of the hot metal and refining agent accumulate on front ends of the single-pipe nozzles, and the injection can be efficiently carried out.

PROBLEMS IN THE ART THE INVENTION AIMS TO SOLVE

In the above-mentioned top placing method (1) the refining agent does not efficiently contact the molten hot metal, and thus, there is a problem in that it is difficult to achieve a sufficient reaction between the refining agent and the molten hot metal during the step in which the molten hot metal flows in the trough.

In the above-mentioned top blowing projection method a considerable projecting pressure is necessary in order to push the refining agent into the molten hot metal, Since a projecting pressure is naturally limited, it is advantageous to make the depth of flowing molten hot metal small and to project the refining agent so that it may reach near the bottom of the flow. In that case, however, the refractory of the trough bottom inevitably suffers from melt-loss immediately below the portion where the projection is made. If a projection is too shallow to invite melt-loss of refractory, a satisfactory effect of the projection is not obtained.

The above-mentioned top blowing injection method (3) poses the same problem as the method (2) of melt-loss of refractory immediately below the portion of the injection and an additional problem of melt-loss of the lance 3 in itself.

Furthermore, by the methods (1) to (3) above, no satisfactory results of refining are achieved with commercially acceptable refining time and amount of the powdered refining agent used. For example, while these methods may desiliconize molten hot metal to a level of [Si]=0.10 to 0.15% by weight, they cannot practically realize [Si]=trace. This is related to the fact that these methods cannot achieve agitation and admixing of the molten metal and refining agent enough to ensure a sufficient reaction thereof.

On the other hand, according to the methods proposed by us in JP A 60-177,114, JP A 60-177,117 and JP A 60-181,212 wherein a powdered refining agent is injected into molten hot metal by use of an oxygen-rich gas, instead of a non-oxidizing gas, as a carrier, wherein the mixture of the oxygen-rich gas, the desired desiliconization and dephosphorization may proceed very effectively. However, when a powdered refining agent 2 is injected into continuously flowing molten hot metal 1 from the bottom thereof through a single-pipe nozzle 6 by use of an oxygen-containing carrier gas 7, as shown in FIG. 4, frequently there happens a phenomenon of "blow through". Namely, if the blow rate is increased, the front end of the jet goes out of the surface of molten hot metal and a part of the refining agent passes through the molten hot metal without reacting with the hot metal. Accordingly, in cases wherein the flow of molten hot metal is shallow, the amount of the carrier gas used is limited and it becomes necessary to install an unduly increased number of nozzles in order to achieve a desired reaction. Furthermore, with a trough and other horizontal vessels, it is frequently a case that they are not allowed to have single-pipe nozzles installed on the bottom thereof from an environmental viewpoint.

OBJECT OF THE INVENTION

An object of the invention is to solve the above-discussed problems associated with the prior art methods and apparatus for the preliminary treatment of molten hot metal for steel making.

SUMMARY OF THE INVENTION

According to the invention there is provided a method for the preliminary treatment of molten hot metal for steel making which comprises continuously passing molten hot metal towards the downstream side in a horizontally disposed trough-like vessel and injecting obliquely downwards a powdered refining agent into the molten hot metal by use of an oxygen-containing gas as a carrier through one or more single-pipe nozzles installed on the side wall of the vessel with the nozzle port being positioned below the surface of the hot metal in the vessel. As an apparatus suitable for use in carrying out the above-mentioned method, the invention further provides an apparatus for the preliminary treatment of molten hot metal which comprises a trough-like vessel with one ore more single-pipe nozzles installed on the side wall of the vessel, said nozzle comprising a pipe which obliquely passes downwards through the thickness of the side wall of the vessel from outside to inside, a substantial length of said pipe on that side contacting molten hot metal being composed of a ceramic pipe having a Vicker's hardness of at least 800 (Hv).

DETAILED DESCRIPTION OF THE INVENTION

Figure 5:
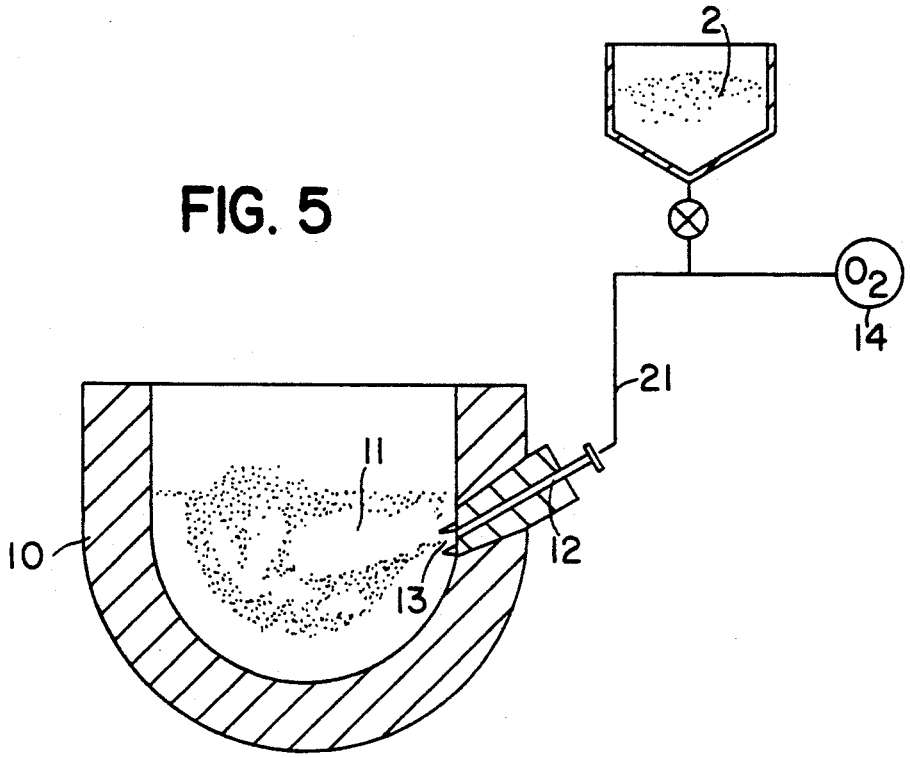
FIG. 5 is a schematic cross-sectional view for illustrating an example of the method for the preliminary treatment of molten hot metal for steel making according to the invention.

FIG. 5 diagrammatically depicts how the method according to the invention is carried out. In a substantially horizontally disposed trough-like vessel 10, molten hot metal 11 is allowed to continuously flow towards the downstream side. FIG. 5 is a vertical cross-section of the vessel 10, at a portion thereof where a single-pipe nozzle 12 is installed, taken along a plane perpendicular to the flow of molten hot metal 11. The single-pipe nozzle 12 is installed on the side wall of the vessel 10 so that the nozzle port 13 is positioned below the surface of the hot metal 11 flowing in the vessel 10 and that it obliquely passes downwards through the thickness of the side wall of the vessel 10 from outside to inside. To the single-pipe nozzle 12 there are supplied an oxygen-containing gas from a source 14 of such a gas and a powdered refining agent 2 by using the oxygen-containing gas as a carrier.

Figure 1:
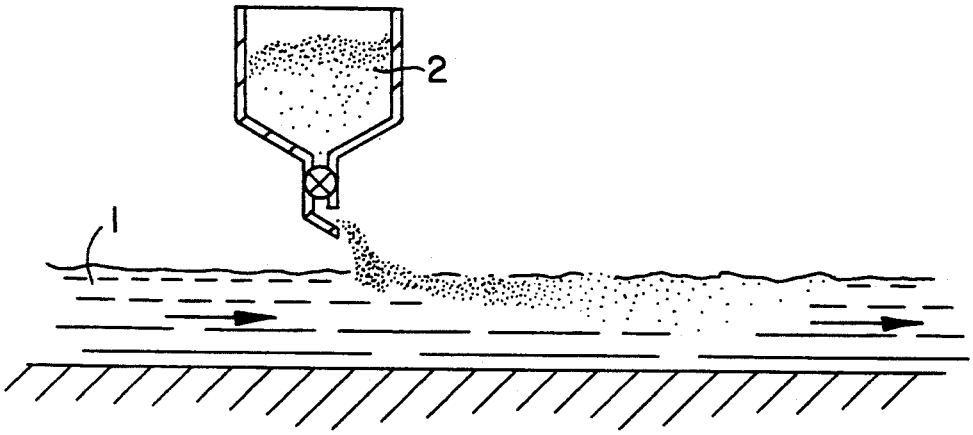
FIGS. 1 to 3 are schematic cross-sectional views for illustrating typical examples of prior art methods for the preliminary treatment of molten hot metal for steel making.
Figure 2:
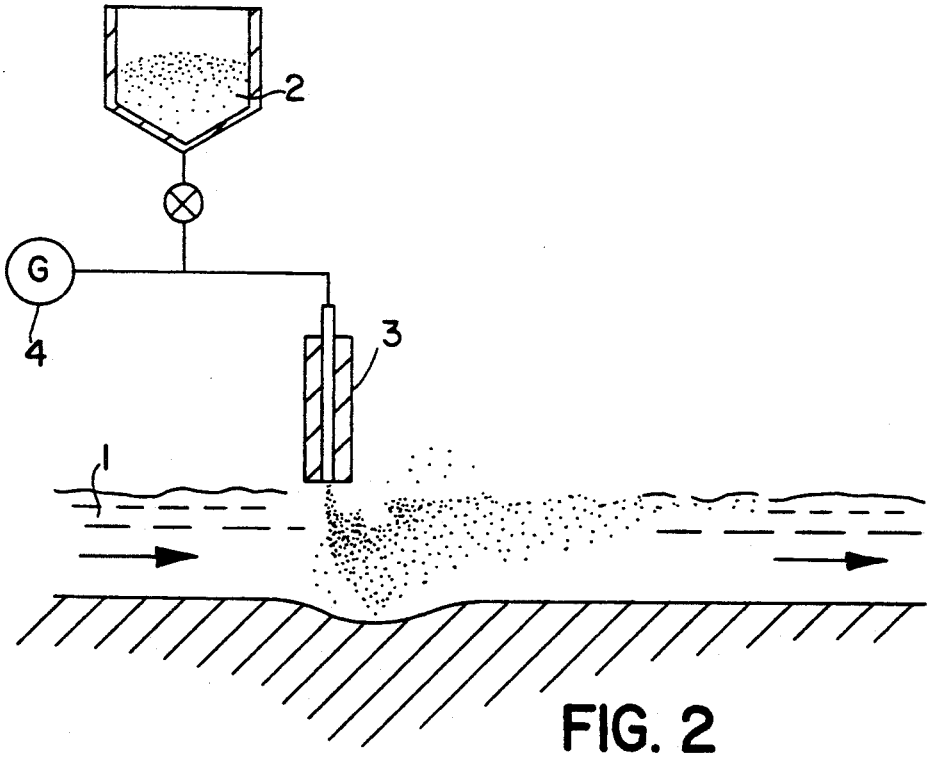
Figure 3:
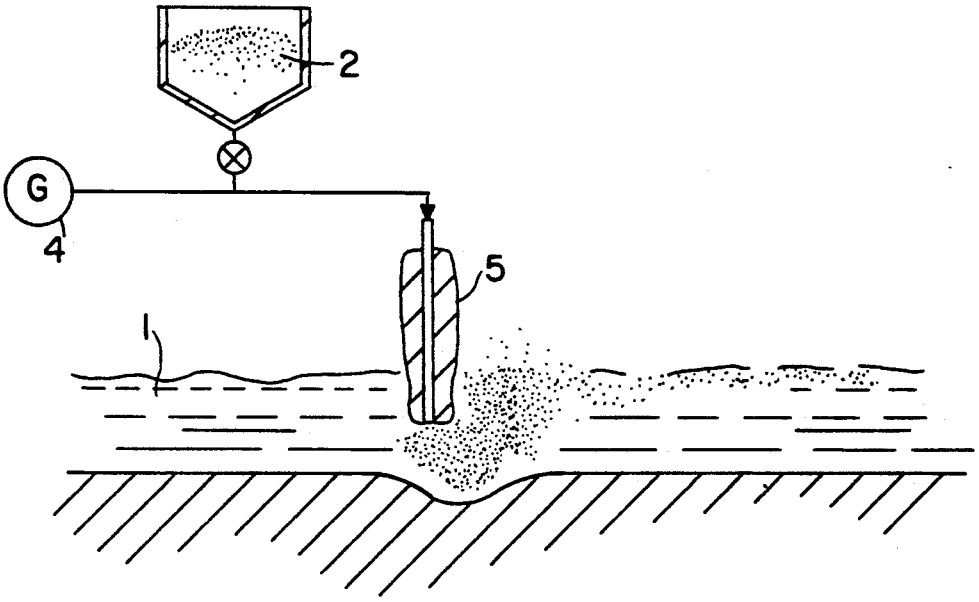
Figure 4:
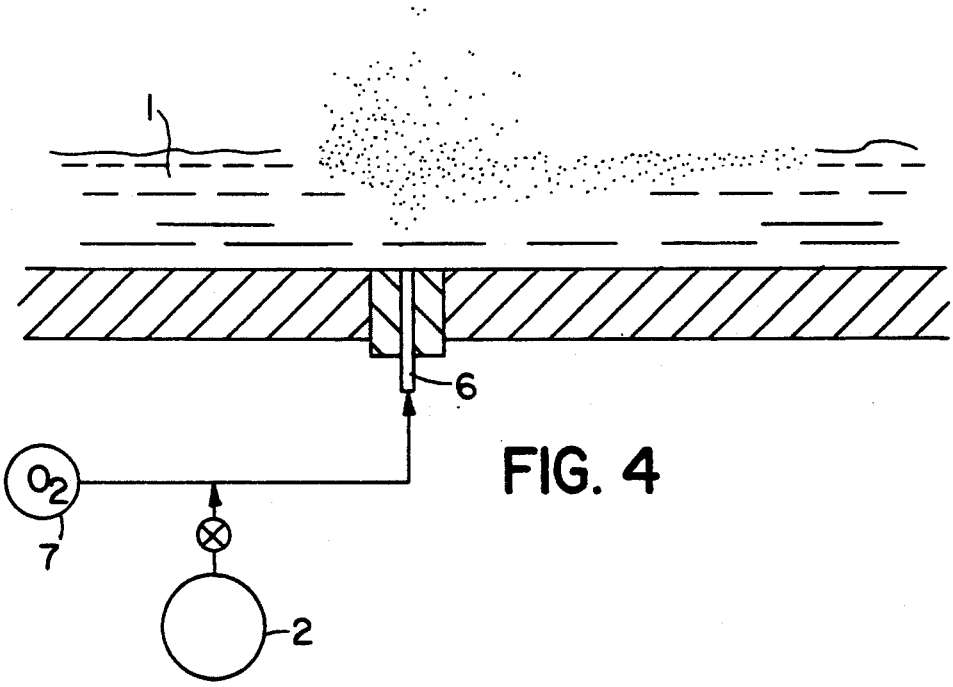
FIG. 4 is a schematic cross-sectional view for illustrating an example of a method for the preliminary treatment of molten hot metal for steel making carried out for a comparison with the method according to the invention.
Figure 6:
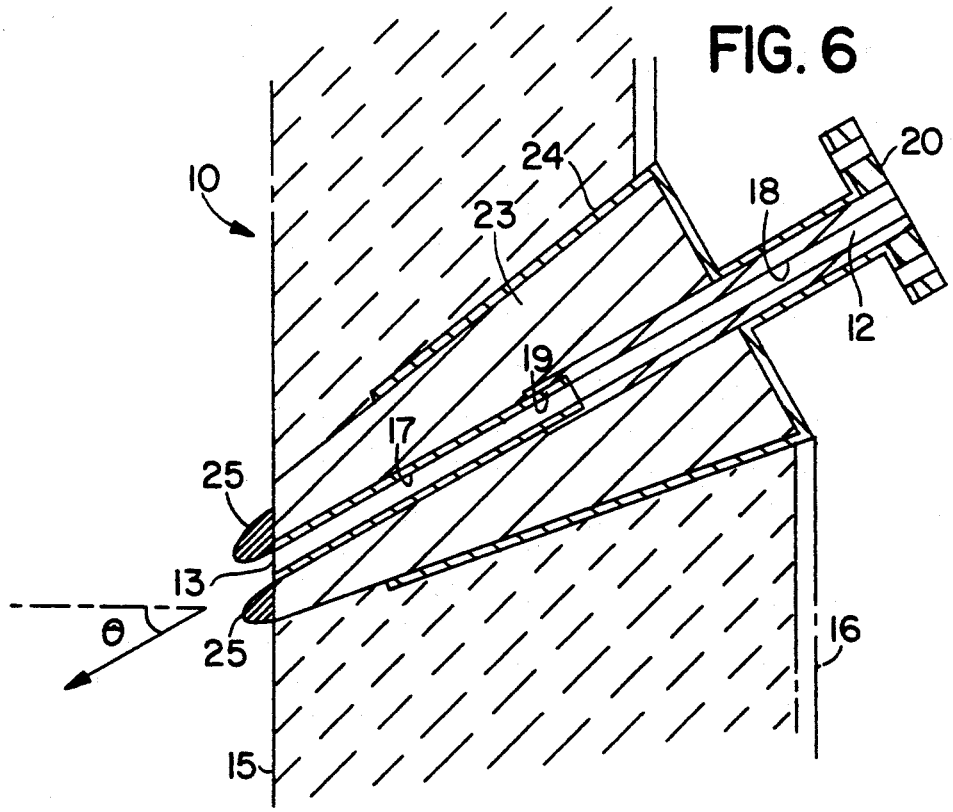
FIG. 6 is a schematic cross-sectional view of an example of a single-pipe nozzle suitable for use in the practice of the invention.

FIG. 6 is a cross-sectional of an example of a suitable single-pipe nozzle. As shown, the single-pipe nozzle 12 obliquely penetrates downwards through the side wall of the vessel 10 from an outside surface 16 thereof toward an inside surface 15 thereof. The single-pipe nozzle 12 comprises a ceramic pipe 17 and a stainless steel pipe 18. One end of the ceramic pipe 17 opens on the inside surface 15 of the side wall of the vessel to form a nozzle port 13, while the other end of the ceramic pipe 17 is connected to one end of the stainless steel pipe 18 within the thickness of the side wall. The other end of the stainless steel pipe 18 extends outwards beyond the outside surface 16 of the side wall and is provided with a flange 20, which is utilized to connect the stainless steel pipe 18 with a pipe 21 (see FIG. 1) for feeding the powdered refining agent 2 carried by the oxygen-containing gas. The ceramic pipe 17 and the stainless steel pipe 18 have the same inner diameter, and at a joint 19 of these pipes they are connected together by coaxially inserting a small length of the ceramic pipe 17 into the stainless steel pipe 18 within the thickness of the latter. The connecting strength may be enhanced by use of an adhesive comprising a heat resistant cement between the pipes at the joint.

In order to securely install the single-pipe nozzle 12 on the refractory side wall of the vessel 10, it is advantageous that the single-pipe nozzle 12 is completely coated with a refractory protecting member 23 having a generally cone-like outer shape, which is further covered by a ferrous skin 24. In that case the ferrous skin 24 is so constructed that while it may cover outside parts of the protecting member 23, it does not cover those parts of the protecting member 23 near the inner surface 15 of the side wall. If such an assembly comprising the protecting member 23, ferrous skin 24 and single-pipe nozzle 12 (ceramic pipe 17 and stainless steel pipe 18) is prefabricated and the side wall is provided with an aperture suitable for the installation of the assembly thereon, maintenance and renewal of the single-pipe nozzle can be readily performed.

The ceramic pipe 17 which forms the nozzle port 13 should have a Vicker's hardness of at least 800 (Hv). Pipes of oxide ceramics such as $ZrO_2$, nitride ceramics such as $Si_3N_4$, carbide ceramics such as SiC and composite ceramics comprising at least 2 oxide, nitride and carbide ceramics may have a Vicker's hardness of at least 800 (Hv).

For example, ceramic pipes of $ZrO_2$ in which a part of the $ZrO_2$ is replaced with $Y_2O_3$ have a Vicker's hardness of about 1350 Hv and a heat shock resistance $\Delta T°$ C. of about 300° C. The heat shock resistance $\Delta T°$ C. of a material is the highest temperature that the material is not destroyed even if it is uniformly heated to that temperature and then quenched in water. Ceramic pipes of $Al_2O_3$ in which a part of the $Al_2O_3$ is replaced with $ZrO_2$ have a Vicker's hardness of about 1450 Hv and a heat shock resistance $\Delta T°$ C. of about 200° C. Ceramic pipes of $Si_3N_4$-SiC series have a Vicker's hardness of about 1000 Hv and a heat shock resistance $\Delta T°$ C. of about 650° C. Pipes of ceramics generally called "SAILON" which are composite ceramics of silicon nitride and oxide have a Vicker's hardness of about 1400 Hv and a heat shock resistance $\Delta T°$ C. of about 900° C. In the practice of the invention it is necessary to use a ceramic pipe having a high hardness and excellent heat shock resistance as exemplified above.

A dip of the single-pipe nozzle 12 (an angle of declination from the horizon designated by $\theta$ in FIG. 6) may be set within the range between 15° and 75° depending upon the distance of the nozzle port 13 from the surface of molten hot metal 11, the depth of molten hot metal and the rate of injecting the mixed fluid. A preferred declination is such that the injected materials may be directed toward a position which is slightly below the imaginary center of gravity of the molten hot metal seen in the vertical cross-section taken along a plane perpendicular to the flow of molten hot metal as in FIG. 5. In any event sharp declinations which may cause the injected materials to strike the bottom of the vessel 10 must be avoided.

In the process according to the invention the powdered refining agent 2 carried by the oxygen-containing gas is injected into the flowing molten hot metal through the single-pipe nozzle 12 as illustrated above. The oxygen-containing gas which can be used herein includes $O_2$-$N_2$ and $O_2$-Ar mixed gases having an oxygen concentration of from 20 to 95 volume %. The powdered refining agent used herein includes ferrous oxide powder, particulate CaO and $CaF_2$, oxides and carbonates of alkali metals and the likes, and may be selected in accordance with the particular purpose of refining. Proportions of the oxygen-containing gas and powdered refining agent of the mixed fluid blown through the single-pipe nozzle 12 are preferably adjusted so that a solid-gas ratio (kg/$Nm^3$) of the fluid = a rate of blowing the powdered refining agent (kg/min.)/a rate of blowing the oxygen-containing gas ($Nm^3$/min.) may fall within the range of from 4 to 50.

When the mixed fluid is continuously injected into molten hot metal through the single-pipe nozzle 12 declined downwards, an annular coagulate as designated in FIG. 6 by reference numeral 25 gradually accumulates and grows on an outer peripheral edge of the nozzle port 13. The annular coagulate 25 is a firm solid coagulate comprising intimately mixed metal and oxides, and maintains its particular shape during the subsequent injection. In cases wherein a powdered refining agent is blown molten hot metal by use of a non-oxidizing gas as a carrier through a single-pipe nozzle, or wherein an oxygen-containing gas carrying no powdered refining agent is blown into molten hot metal through a single-pipe nozzle, any coagulate, if formed, does not maintain its shape during the subsequent injection, or no coagulate is formed. Only when the powdered refining agent is injected into molten hot metal by use of the oxygen-containing gas as a carrier through the single-pipe nozzle 12 in accordance with the invention, the annular coagulate 25 comprising a reaction product of hot metal and the blown materials is formed on the outer peripheral edge of the nozzle port 13, providing a new nozzle port 25. By virtue of the formation of the new nozzle port 25, the process can be stably continued for a prolonged period of time without melt-loss of the nozzle port 13 of the single-pipe nozzle 12 in spite of blowing the oxygen-containing gas.

It has been confirmed that the new nozzle 25 is favorably formed in the process according to the invention in spite of the facts the single-pipe nozzle 12 is declined downwards by a dip $\theta$ of from 15° to 75° and molten hot metal is caused to continuously flow in a direction across the direction of injection. Thus, in the process according to the invention the oxygen-containing gas and powdered refining agent can be continuously fed into flowing molten hot metal under condition that the new nozzle 25 has been formed and the direction of injection is oblique downwards. Accordingly, the method according to the invention does not suffer from the problems as discussed hereinbefore with reference to FIGS. 1 to 4 and is productive of excellent desiliconization and dephosphorization results as demonstrated in the following Examples.

EXAMPLE 1

Molten hot metal for use in the production of mild steel was caused to flow in a trough-shaped reactor of a width of 80 cm at a flow rate of 30 t/hr so that the depth of the flowing molten hot metal may be about 40 cm. Through a ceramic single-pipe nozzle having an inner diameter of 17 mm, disposed on the side wall of the reactor under conditions including a dip $\theta = 30°$ and a position of nozzle port = about 6 cm below the surface of molten hot metal, a powdered refining agent, scale powder (iron oxide) + CaO + $CaF_2$, was injected into the molten hot metal by use of a mixed $O_2$-$N_2$ gas having an oxygen concentration of 90 vol. % as a carrier, at a rate of blowing powder = 30 kg/min. and a rate of blowing gas = 2.9 $Nm^3$/min.

The hot metal prior to the treatment had [Si %] = 0.49%, [P %] = 0.098% and a temperature of 1332° C. After the treatment the hot metal had [Si %] = trace, [P %] = 0.017% and a temperature of 1342° C. In respect of both the reactor refractory and single-pipe nozzle, no melt-loss was observed.

EXAMPLE 2

Example 1 was repeated except for an inner diameter of nozzle = 25 mm, a flow rate of molten hot metal = 96 t/hr, a rate of blowing powder = 85 kg/min. and a rate of blowing gas = 6.5 $Nm^3$/min.

The hot metal prior to the treatment had [Si %] = 0.32%, [P %] = 0.095% and a temperature of 1350° C. After the treatment the hot metal had [Si %] = trace, [P = 0.015% and a temperature of 1345° C. In respect of both the reactor refractory and single-pipe nozzle, no melt-loss was observed.

COMPARATIVE EXAMPLE

Using the same apparatus of Example 1 except that the single-pipe nozzle was disposed on the bottom wall of the reactor, the preliminary treatment of the molten hot metal of Example 1 was carried out except that the refining agent was injected into the molten hot metal of the same depth of 40 cm as in Example 1 by bottom blowing the carrier gas. There occurred the so called phenomenon of "blow through".

Accordingly, the nozzle was replaced with 12 single-pipe nozzles having an inner diameter of 5 mm disposed on the bottom wall of the reactor, and the preliminary treatment was repeated at a rate of blowing powder = 3.7 kg/min. and a rate of blowing gas = 0.25 $Nm^3$/min. The total iron content in the slag (T. Fe) was 1.72% and CaO in the slag was 67% of blown CaO. The preliminary treatment was repeated at a rate of blowing powder = 3 kg/min. and a rate of blowing gas = 0.2 $Nm^3$/min. The total iron content in the slag (T. Fe) was 0.9% and CaO in the slag was 95% of blown CaO.

The results of these comparative examples indicate that when the preliminary treatment of molten hot metal is carried out by injecting a refining agent with a bottom blown oxygen containing carrier gas, an efficient treatment cannot be made unless the rates of blowing and amounts of blown materials are remarkably reduced. In contrast thereto, it has been found that in the process according to the invention wherein the materials are obliquely injected downwards into molten hot metal, a rate of blowing of powder as high as 50 kg/min. and a rate of blowing of gas as high as 5 $Nm^3$/min.can be realized, provided that the diameter and declination angle of the nozzle are properly selected.

Figure 7:
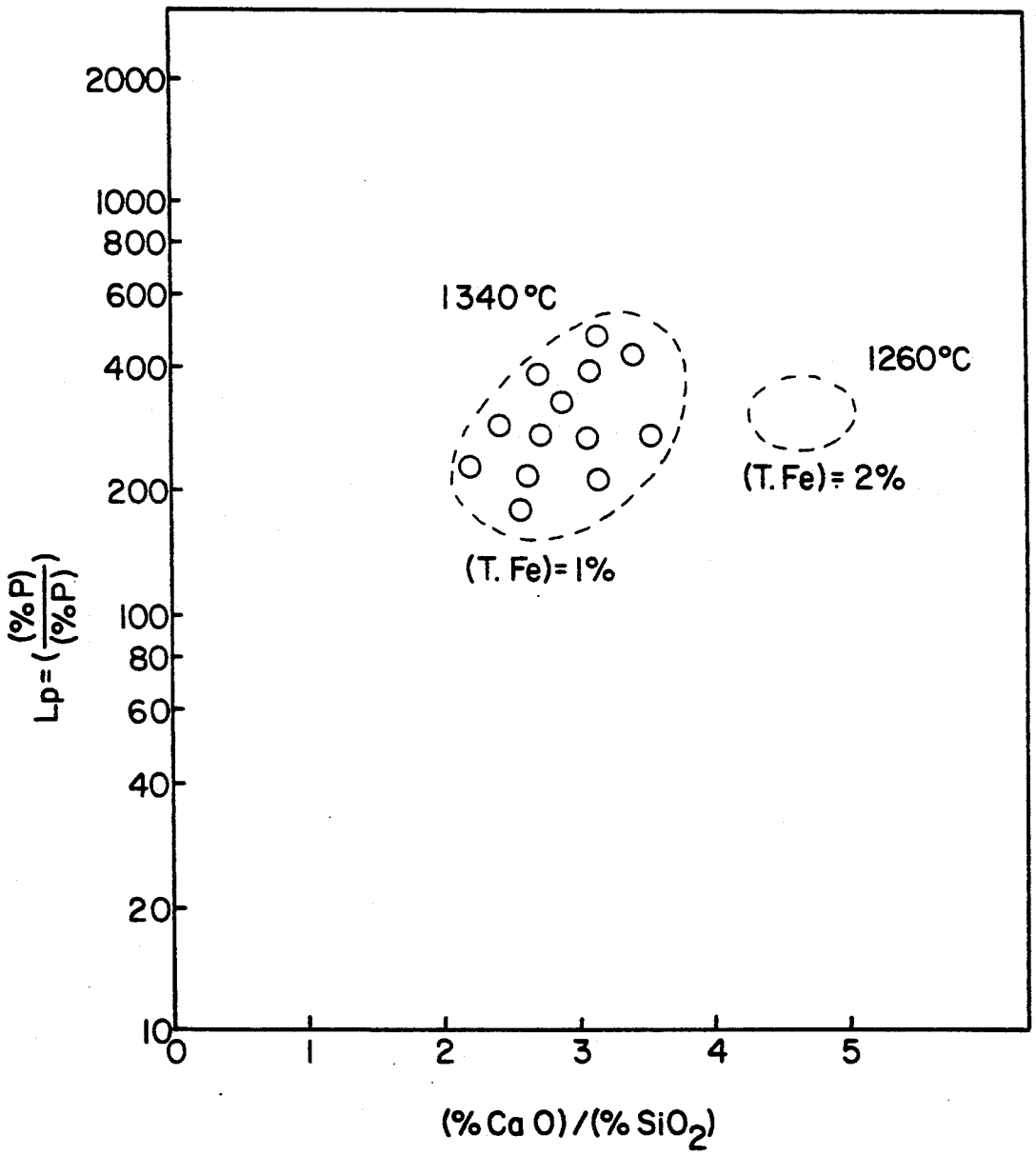
FIG. 7 is a graphical showing of dephosphorization effect according to the invention in terms of the relation between the basicity of slag and the P distribution ratio.

A plurality of preliminary treatments of molten hot metal as in Examples 1 and 2 were repeated to examine the basicity of slag = (% CaO)/(% $SiO_2$) and the P distribution ratio between slag and metal Lp = (% P)/[% P]. The results are shown in FIG. 7 in which (T. Fe) designates the total amount of iron in the formed slag. For comparison purposes, further shown in FIG. 7 are data of the prior art method wherein a similar refining agent is injected into molten hot metal contained in a ladle car by use a non-oxidizing gas as a carrier.

The results of FIG. 7 reveal an interesting fact that by the process according to the invention, a high P distribution ratio is obtained under conditions of a low slag basicity and a high temperature. It has been a commonly accepted way of thinking that the dephosphorization of hot metal requires a relatively low temperature, a high slag basicity and a high (FeO). Nevertheless, an effective dephosphorization, as reflected by a high P distribution ratio, can be realized by the process according to the invention in spite of the conditions of a low slag basicity, a high temperature and a low (FeO). While an exact operation mechanism underlying this interesting fact is not yet fully understood, it is believed that in the process according to the invention near the nozzle port positioned at a place where the depth of molten hot metal is shallow there is formed an area of a high oxygen potential where dephosphorization effectively proceeds, and since the distance along which the formed slag floats upwards is short, a phenomenon causing rephosphorization may be suppressed. At the same time of this dephosphorization there can be achieved desiliconization in the method according to the invention, and therefore, it is not necessary to carry out the desiliconization prior to the dephosphorization as required in the prior art methods.

We claim:

1. A method for the treatment of molten hot metal to effect desiliconization and dephosphorization thereof prior to decarburization thereof for steel making which comprises continuously passing the molten hot metal in a horizontally disposed trough-shaped refractory vessel and injecting obliquely downwardly, a powdered refining agent comprising CaO, $CaF_2$ and iron oxide into the molten hot metal by use of an oxygen-containing gas whose oxygen concentration is at least 20% by volume as a carrier, through one or more nozzles installed on the side wall of the vessel, with the nozzle port being positioned below the surface of the hot metal in the vessel.

2. An apparatus for the desiliconization and dephosphorization of molten hot metal, prior to decarburization thereof, for steel making, which comprises a trough-like vessel with one or more single-pipe nozzles installed on the side wall of the vessel, said nozzle comprising a pipe which obliquely passes downwardly through the thickness of the side wall of the vessel from the outside to the inside, a substantial length of said pipe on the side contacting molten hot metal being composed of a ceramic pipe having a Vicker's hardness of at least 800 (Hv).

* * * * *